United States Patent [19]

Coller et al.

[11] Patent Number: 4,782,868

[45] Date of Patent: Nov. 8, 1988

[54] WOOD SPLITTER BACK HOE ATTACHMENT

[76] Inventors: Roy E. Coller, 136 Sipes Rd., Freeport, Pa. 16229; George Spector, 233 Broadway RM 3815, New York, N.Y. 10007

[21] Appl. No.: 115,837

[22] Filed: Nov. 2, 1987

[51] Int. Cl.[4] ..... B27L 7/00

[52] U.S. Cl. ..... 144/193 A; 144/193 R; 144/366

[58] Field of Search ..... 144/3 K, 143 R, 143 A, 144/143 E, 366

[56] References Cited

U.S. PATENT DOCUMENTS

| | | | |
|---|---|---|---|
| 4,019,549 | 4/1977 | Williams | 144/193 E |
| 4,073,325 | 2/1978 | Krom, Jr. | 144/3 K |
| 4,086,111 | 4/1978 | Corey | 144/3 K |
| 4,111,246 | 9/1978 | LaPointe | 144/193 A |
| 4,155,385 | 5/1979 | Lapointe | 144/193 A |
| 4,615,367 | 10/1986 | Crowley, Jr. | 144/366 |

*Primary Examiner*—W. Donald Bray

[57] ABSTRACT

A wood splitter attachment for a backhoe is provided and includes a base member with a platform to support the wood thereupon attached to the dipperstick of the backhoe and a wedge member attached to the hydraulic curl cylinder of the backhoe to split the wood. In a modification the platform is adjusting to the wood securely and in another modification a bottom wedge member is provided to be activated by weight of the wood bearing down upon the platform.

2 Claims, 1 Drawing Sheet

WOOD SPLITTER BACK HOE ATTACHMENT

BACKGROUND OF THE INVENTION

The instant invention relates generally to log splitting devices and more specifically it relates to a wood splitter attachment for a backhoe.

Numerous log splitting devices have been provided in prior art that are adapted to be attached to backhoe vehicles which will supply power to the devices for splitting the logs. For example, U.S. Pat. Nos. 4,444,231; 4,453,580 and 4,615,367 all are illustrative of such prior art. While these units may be suitable for the particular purpose to which they address, they would not be as suitable for the purposes of the present invention as heretofore described.

SUMMARY OF THE INVENTION

A primary object of the present invention is to provide a wood splitter attachment for a backhoe that will overcome the shortcomings of the prior art devices.

Another object is to provide a wood splitter attachment for a backhoe which will be attached to the dipperstick and hydraulic curl cylinder of the backhoe in place of the existing digging bucket to split wood in a minimum amount of time.

An additional object is to provide a wood splitter attachment for a backhoe which will include an adjusting base member to hold wood securely to be split.

A further object is to provide a wood splitter attachment for a backhoe that is simple and easy to use.

A still further object is to provide a wood splitter attachment for a backhoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
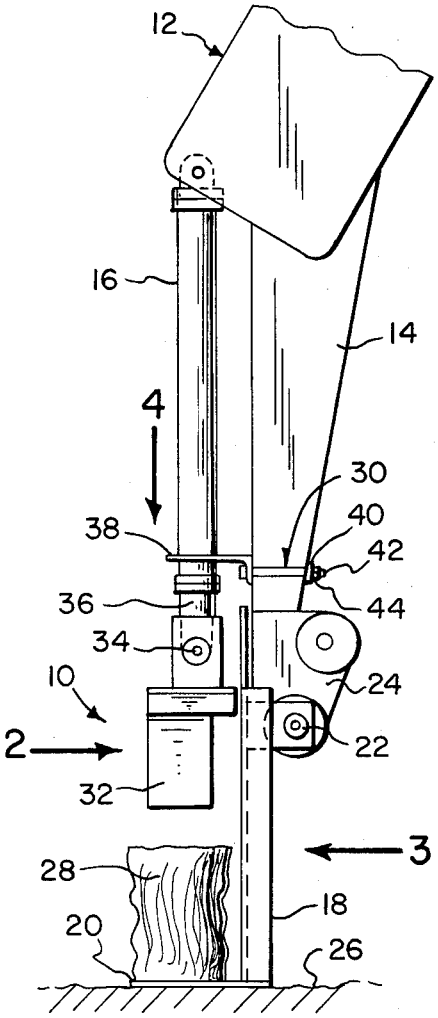
FIG. 1 is a side view of the invention secured to a backhoe which is shown fragmentary.
Figure 2:
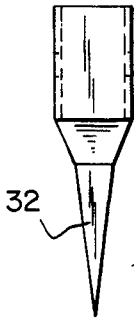
FIG. 2 is a front view of the wedge member as indicated by arrow 2 in FIG. 1.
Figure 3:
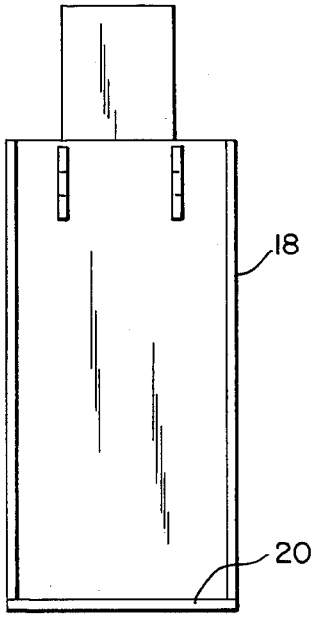
FIG. 3 is a rear view of the base member as indicated by arrow 3 in FIG. 1.
Figure 4:
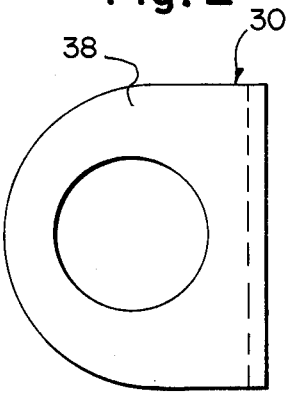
FIG. 4 is a top view of the cylinder support bracket as indicated by arrow 4 in FIG. 1.

Turning now descriptively to the drawings, in which similar reference characters denote similar elements throughout the several views, FIGS. 1 through 4 illustrate a wood splitter attachment 10 for a backhoe 12 that has a dipperstick 14 and a hydraulic curl cylinder 16. The wood splitter attachment 10 consists of a base member 18 that has a platform 20, in which the base member 18 is mounted by pin 22 on free end 24 of the dipperstick 14 in a vertical position so that the platform 20 is in a horizontal position to contact the ground 26 and support the wood 28 thereupon. A fixture 30 is for holding the hydraulic curl cylinder 16 in a vertical position above the platform 20 of the base member 18. A wedge member 32 is mounted by pin 34 onto free end 36 of the hydraulic curl cylinder 16 which drives the wedge member 32 down into contact with the wood 28 so as to split the wood apart.

The holding fixture 30 includes a cylinder support bracket 38 and a back plate 40 both mounted by two bolts 42 and two nuts 44 in conjunction with each other onto the dipperstick 14 adjacent the free end 24 thereof.

Figure 6:
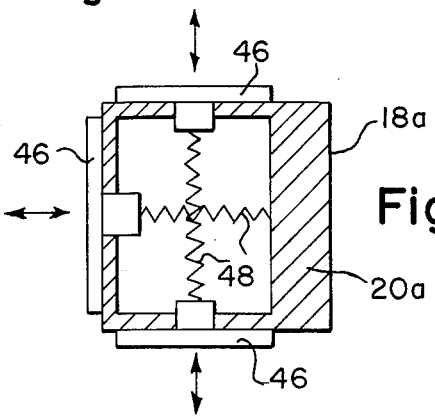
FIG. 6 is a cross sectional view taken along line 6—6 in FIG. 5 showing the spring mechanism within the adjusting platform.
Figure 5:
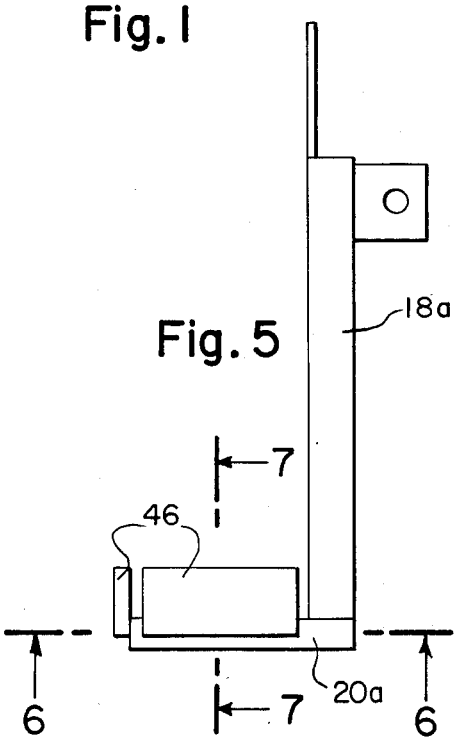
FIG. 5 is a side view of a modified base member having an adjusting platform to hold the wood securely.

FIGS. 5 and 6 show a modified base member **18*a* in wich the platform 20*a* is of an adjusting type that includes three side plates 46 that are normally spring biased inwardly by springs 48 to hold the wood 28** securely thereupon.

Figure 7:
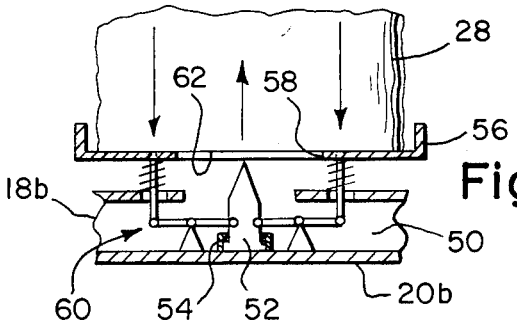
FIG. 7 is a cross sectional view taken along line 7—7 in FIG. 5 showing a bottom wedge member activated by weight of the wood bearing on the platform.

FIG. 7 shows another modified base member **18*b* in which the platform 20*b* of the base member has a hollow compartment 50 therein. A bottom wedge member 52 is moveably postioned at 54 within the hollow compartment 50 of the platform 20*b* and extends vertically upwardly therefrom. An upper auxiliary platform 56 that has a central aperture 58 therein is positioned over the platform 20*b* of the base member 18*a* and is in conjunction with the bottom wedge member 52. A spring biased fulcrum lever system 60 is for driving the bottom wedge member 52 through the central aperture 58 of the upper auxiliary platform 56 and into contact with bottom 62 of the wood 28 when weight of the wood bears down upon the upper auxiliary platform 56**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wood splitter attachment for a backhoe having a dipperstick and a hydraulic curl cylinder, said wood splitter attachment comprising:

(a) a base member having a platform, said base member mounted on a free end of the dipperstick in a vertical position so that the platform is in a horizontal position to contact the ground and support the wood thereupon;

(b) means for holding the hydraulic curl cylinder in a vertical position above the platform of said base member; and (c) a wedge member mounted onto a free end of the hydraulic curl cylinder which drives said wedge member down into contact with the wood so as to split the wood apart; wherein said holding means includes a cylinder support bracket and a back plate both mounted in conjunction with each other onto the dipperstick adjacent the free end thereof, wherein said base member further comprises the platform being of an adjusting type that includes three transversely moveable side plates with spring means biasing said plates inwardly against the wood to hold the wood securely on said platform.

2. A wood splitter attachment for a backhoe having a dipperstick and a hydraulic curl cylinder, said wood splitter attachment comprising:

(a) a base member having a platform, said base member mounted on a free end of the dipperstick in a vertical position so that the platform is in a horizontal position to contact the ground and support the wood thereupon;

(b) means for holding the hydraulic curl cylinder in a vertical position above the platform of said base member; and (c) a wedge member mounted onto a free end of the hydraulic curl cylinder which drives said wedge member down into contact with the wood so as to split the wood apart, wherein said holding means includes a cylinder support bracket and a back plate both mounted in conjunction with each other onto the dipperstick adjacent the free end thereof, further comprising:

(d) the platform of said base member having a hollow compartment therein;

(e) a bottom wedge member moveably positioned within the hollow compartment of the platform and extending vertically upwardly therefrom;

(f) an upper auxiliary platform having a central aperture therein, said upper auxiliary platform positioned over the platform of said base member and being in conjunction with said bottom wedge member; and (g) means for driving said bottom wedge member through the central aperture of the upper auxiliary platform and into contact with bottom of the wood when weight of the wood bears down upon said upper auxiliary platform.

* * * * *